United States Patent [19]

Marchesano

[11] 4,232,113

[45] Nov. 4, 1980

[54] LIQUID CONCENTRATED DEVELOPER COMPOSITION, AND CONFECTION READY TO MIX WITH WATER INCLUDING IT, FOR USE IN COLOR PHOTOGRAPHY

[75] Inventor: Carlo Marchesano, Savona, Italy

[73] Assignee: Minnesota Mining and Manufacturing Company, St. Paul, Minn.

[21] Appl. No.: 20,313

[22] Filed: Mar. 14, 1979

[51] Int. Cl.[2] ..... G03C 5/30

[52] U.S. Cl. ..... 430/450; 430/466; 430/467

[58] Field of Search ..... 96/66.1, 66.2, 66; 430/450, 466, 467

[56] References Cited

U.S. PATENT DOCUMENTS

| | | | |
|---|---|---|---|
| 2,784,086 | 3/1957 | Henn | 96/66.1 |
| 3,342,599 | 9/1967 | Reeves | 96/66.1 |
| 3,347,675 | 10/1967 | Henn et al. | 96/66.2 |
| 3,348,946 | 10/1967 | Jones | 96/66.1 |
| 3,438,776 | 4/1969 | Yudelson | 96/50 R |
| 3,721,563 | 3/1973 | Fisch et al. | 96/66.1 |
| 3,785,824 | 1/1974 | Fisch | 96/66.1 |
| 3,981,732 | 9/1976 | Emoto | 96/66.2 |
| 3,996,054 | 12/1976 | Santemma | 96/66.1 |

*Primary Examiner*—Mary F. Downey

*Attorney, Agent, or Firm*—Cruzan Alexander; Donald M. Sell; Mark A. Litman

[57] ABSTRACT

Developer for use in color photography confectioned in a plurality of concentrated compositions in which one first concentrated composition is a liquid composition substantially free of water including the p-phenylenediamine compound, and possibly other components of the developer such as antioxidants, dissolved in an organic solvent.

21 Claims, No Drawings

LIQUID CONCENTRATED DEVELOPER COMPOSITION, AND CONFECTION READY TO MIX WITH WATER INCLUDING IT, FOR USE IN COLOR PHOTOGRAPHY

The present invention refers to liquid concentrated developer compositions for use in colour photography. Particularly, the present invention refers to liquid concentrated developers which are confectioned into more concentrated parts to dilute with water to give colour developer baths ready to use in colour photography.

Generally, a developer solution for use in colour photography, consists of a water solution of various components in addition to the p-phenylenediamine developer which is oxidized by the exposed silver halide to react with a coupler to form a dye.

Such components normally include an antioxidant(s) and an alkalizing agent(s) and various additional compounds such as a buffering agent(s), an anticalcium agent(s) (see for example U.S. Pat. Nos. 2,656,273, 3,462,269, 3,201,246, 3,214,654, 3,994,730, FR Pat. No. 2,251,036 and Research Disclosure No. 13410, 1975), an optical brightner (s) (as for example described in Research 17643-V, 1978), as well as other known development modifiers such as for example described in the above cited Research Disclosure 17643(1978) with particular reference to paragraph XXI. Particular mention as to crytical components is to be made to said antioxidant compounds and to benzylalcohol which is normally used, as development accelerator, in developers for Color Paper films (as described for example in U.S. Pat. No. 2,304,925).

The pH pf the developer solution ready to use is generally obtained by mixing with water a plurality of concentrated compositions (preferably liquid aqueous compositions) one of which is acid (for example the one including the p-phenylenediamine compound) and another of which is basic. The normal pH values normally range from 10 to 11.50 depending upon both the film (positive, negative, paper and reversal films) and the developer used.

It is material to the market of the chemistry for the colour photographic processing that such water solution of p-phenylenediamine developing agent and additional components be prepared from concentrated composition easy to mix with water, such compositions being stable in the various storage conditions (the stability problems are particularly crytical as far as the p-phenylene diamine compound is concerned). Since it is not possible to make a single concentrated composition of the developer solution as such (for both solubility and stability problems), it has become normal practice in the air to divide and confection it into various groups of components to mix in water to prepare the bath ready to use.

Such groups or compositions generally include one or more components of the developing bath, both in liquid or solid form. Two features may be pointed out as essential to said groups or compositions, the first being that they are to be as less as possible and the second being that they are to be stable to the various conditions of shipment and storage.

A third desirable feature of said compositions would be that they are liquid and easy to mix in water without any prolonged stirring.

It is particularly desired in the market to have a developer confectioned into concentrated prepared compositions showing said third feature combined with said first and second features.

Although many attempts and studies have been made in the past, it is believed that no satisfactory results have been reached as desirable.

A prepared developer composition, for example, has been described in U.S. Pat. No. 3,615,572 consisting of four parts, the first containing a p-phenylene diamine developer in acid water solution including sulphite, the second containing hydroxylamine sulphate, the third containing alkali and buffering agent, the fourth including benzyl alcohol.

Further examples of prepared developers confectioned into a plurality of concentrated compositions can be found in U.S. Pat. No. 3,814,606. Such prepared developers consist of a first concentrated composition containing benzylalcohol, diethylenglycol, hydroxylamine chlorohydrate and water, a second concentrated composition containing an alkali and a buffering agent in water, a third concentrated composition containing a color developer in dry powder or in water acid solution with a sulfite.

All these prepared developers have at least one of the following drawbacks: (a) excessive number of concentrated parts; (b) said concentrated parts cannot be easily mixed with water; (c) said concentrated parts, when containing the color p-phenylenediamine compounds, are not very stable under all the storage condictions available on the market.

Particularly, for example, a prepared developer composition, consisting of two parts, is described in U.S. Pat. No. 3,574,619. Such composition usually consists of a first part containing water, benzyl alcohol, a ethylene glycol, a silver halide p-phenylene diamine developer and a sulfite, and a second part containing an aqueous alkali. This developer composition has however some disadvantages: (a) formation of a turbid mass during the addition of benzyl alcohol to the water solution of the color developer and the sulphite; (b) degradation of the developer if the composition is stored at high temperatures.

It is the main object of the present invention to provide a method to confection a color photographic developer in a plurality of liquid concentrated compositions stable and fast to mix in water. It is a particular object of the present invention to provide a method to confection a color photographic developer in a minimum number of liquid concentrated compositions stable and fast to mix with water. It is a further object of the present invention to provide a prepared developer confectioned in a plurality of concentrated liquid compositions stable and fast to mix water water. It is a particumar object of the present invention to provide a prepared developer confectioned in a minimum number, preferably two, of concentrated liquid compositions stable and fast to mix with water.

According to the present invention, such objects can be reached by confectioning all or substantial part of the colour photographic developer in two liquid concentrated compositions the first of which including the p-phenylene diamine colour developing agent dissolved in a substantially water-free organic solvent to form a substantially non aqueous solution and the second substantially consisting of aqueous alkali.

According to the present invention it has been found, in fact, that, given a developer ready to use, including the p-phenylene diamine compound and other components as known in the art, it is possible to prepare it in a

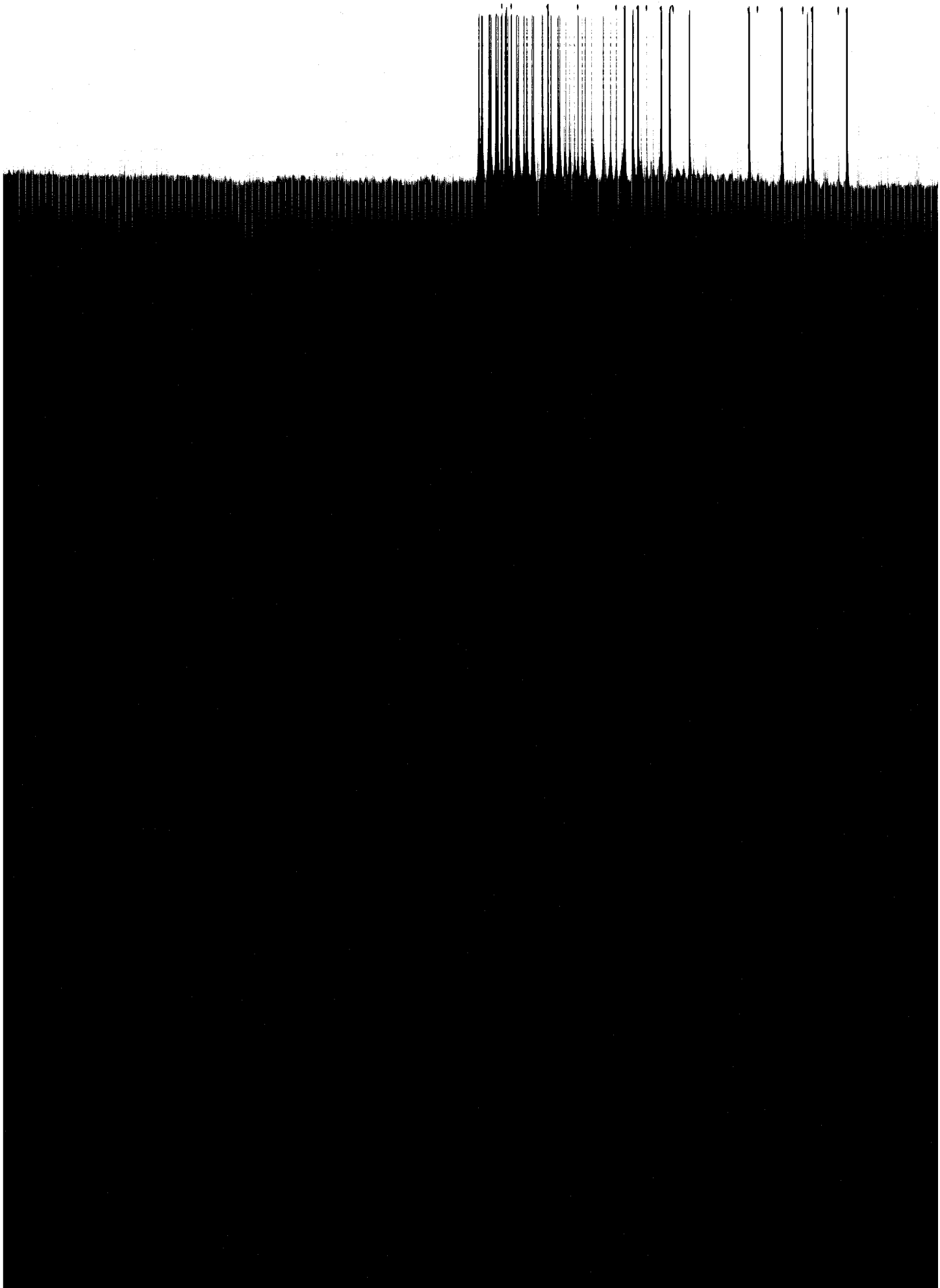
1
2 further refers to the same confectioned developer in which the liquid composition substantially free of water including the p-phenylenediamine compound includes also an antioxidant agent, such agent particularly being a sulphite (ion releasing) compound, or a hydroxylamine compound, or an ascorbic acid compound, or acetol, or combination of two or more of them, particularly hydroxylamine with sulphite or hydroxylamine with ascorbic acid or acetol. Particularly,—and preferably—, the present invention refers to a developer of the above described type confectioned in only two concentrated compositions, preferably including said liquid concentrated composition substantially free of water containing the p-phenylenediamine compound, a hydroxylamine compound, benzylalcohol and a compound chosen within a sulphite compound, an ascorbic acid compound, an acetol type compound, preferably ascorbic acid.

Further, and still particularly, the present invention refers to a developer of the above described type confectioned in three concentrated compositions including said first and second liquid compositions, as described, and a third liquid composition including a hydroxylamine compound solved in water or in an organic, solvent preferably an organic solvent.

Preferably, the organic solvent used to the purposes of the present invention is chosen within the class of dihydric alcohols, polyhydric alcohols and polyoxyethyleneglycols or mixtures thereof and more preferably it is ethyleneglycol.

In a second aspect the present invention refers to a method for confectioning a colour developer in concentrated prepared compositions which consists in dissolving the components of such developer in a plurality of liquid compositions characterized by the fact that one of them is obtained by dissolving the p-phenylenediamine compound in an organic solvent to obtain a substantially non aqueous liquid composition.

In a further aspect the present invention refers to a liquid concentrated composition of a p-phenylene diamine compound for use in prepare colour photographic developers characterized in that the p-phenylenediamine compound is contained in a water-miscible organic solution substantially free of water. In a particular aspect said solution may contain one or more of compounds chosen within hydroxylamine, sulphite, ascorbic acid and acetol compounds as previously described.

Particularly,—and preferably—, the present invention refers to said concentrated compositions including benzylalcohol. More preferably it refers to a composition including a p-phenylene-diamine compound, hydroxylamine, benzylalcohol and one compound chosen among sulphite, ascorbic acid and acetol type compound, preferably ascorbic acid.

The invention is now described with reference to some experiments made by the Applicant.

EXAMPLE 1

The developer components for color photographic paper were confectioned in the following concentrated liquid compositions necessary to prepare one liter of developer replenisher ready for use:

Composition A

| | | |
|---|---|---|
| Ethylenglycol | 50 | ml |
| Hydroxylamine chlorohydrate | 2.75 | g |

-continued

| | | |
|---|---|---|
| Potassium metabisulfite | 1 | g |
| CD3 | 7 | g |
| Optiblanc AC (Optical brightener sold in Italy by Sigma) | 2.5 | g |
| Benzyl alcohol | 18.3 | ml |

wherein the components were progressively and completely dissolved in the ethyleneglycol in the indicated order till a volume of 77 ml was obtained.

Composition B

| | | |
|---|---|---|
| Water | 30 | ml |
| KOH 35% | 7 | ml |
| Diethylentriaminopentacetic acid | 1.6 | g |
| Potassium metabisulfite | 1.45 | g |
| Potassium carbonate | 32 | g |

EXAMPLE 2

The developer components for color photographic paper were confectioned in the following concentrated liquid compositions necessary to prepare one liter of developer replenisher ready for use:

Composition A

| | | |
|---|---|---|
| Ethylenglycol | 42 | ml |
| Benzyl alcohol | 18.3 | ml |
| Hydroxylamine chlorohydrate | 2.75 | g |
| Sodium metabisulfite | 0.9 | g |
| CD3 | 7 | g |
| Optiblanc AC | 2.5 | g |

wherein the components were progressively and completely dissolved in the ethylenglycol in the indicated order till a volume of 67.5 ml was obtained.

Composition B

The same as described in Example 1.

EXAMPLE 3

The developer components for color photographic paper were confectioned in the following concentrated liquid compositions necessary to prepare one liter of developer replenisher ready for use.

Composition A

| | | |
|---|---|---|
| Ethylenglycol | 30 | ml |
| Glycerin | 5 | ml |
| Sodium metabisulfite | 0.9 | g |
| Benzylalcohol | 18.3 | ml |
| Hydroxylamine chlorohydrate | 2.75 | g |
| Optiblanc AC | 2.5 | g |
| CD 3 | 7 | g |

wherein the components were progressively and completely dissolved in the ethylenglycol and in the glycerin in the indicated order till a volume of 58 ml was obtained.

Composition B

The same as that described in Example 1.

EXAMPLES 4, 5, 6, 7 AND 8

The developer components for color photographic paper were confectioned in two concentrated liquid compositions necessary to prepare one liter of developer replenisher ready for use, the first composition being like Composition A of Example 2 but having the following solvents instead of 42 ml of ethylenglycol:

| Example | Solvent | Quantity | Final Volume |
|---|---|---|---|
| 4 | Ethylenglycol | 20 ml | 50 ml |
| 5 | Triethylenglycol | 50 ml | 85 ml |
| 6 | Ethylenglycol/glycerin | 15/30 ml | 80 ml |
| 7 | Diethylenglycol | 50 ml | 86 ml |
| 8 | Propylenglycol | 80 ml | 110 ml |

and Composition B of each example being the same as that of Example 2.

EXAMPLE 9

The developer components for color photographic papers were confectioned in two concentrated liquid compositions necessary to prepare one liter of developer replenisher ready for use.

Composition A

It was prepared by adding a mixture of 20 ml of ethylenglycol and 1.2 g of sodium sulfite to a solution of 2.75 g of hydroxylamine chlorohydrate in 20 ml of ethylenglycol, stirring till a limpid solution was obtained and finally by progressively and completely dissolving the following products in the indicated order:

| | | |
|---|---|---|
| Benzyl alcohol | 18.3 | ml |
| Optiblanc AC | 2.5 | g |
| CD3 | 7 | g |

till a final volume of 65 ml was obtained.

Composition B

The same as that described in Example 1.

EXAMPLE 10

The developer components for color photographic paper were confectioned in two concentrated liquid compositions to obtain one liter of developer replenisher ready for use:

Composition A

| | | |
|---|---|---|
| Ethylenglycol | 42 | ml |
| Optiblanc AC | 2.5 | g |
| Benzyl alcohol | 18.3 | ml |
| Sodium metabisulfite | 0.9 | g |
| CD3 | 7 | g |
| Hydroxylamine chlorohydrate | 2.75 | g |

wherein the components were progressively and completely dissolved in the indicated order till a final solution of 67.5 ml was obtained.

Composition B

| | | |
|---|---|---|
| Water | 24 | ml |
| KOH 35% | 8 | ml |
| Diethylentriaminopentacetic acid | 1.6 | g |
| Diaminopropanoltetracetic acid | 1.5 | g |
| Potassium metabisulfite | 1.45 | g |
| Potassium carbonate | 32 | g |

EXAMPLE 11

The developer components for color photographic paper were confectioned in two concentrated liquid compositions necessary to prepare one liter pf developer replenisher ready for use.

Composition A

| | | |
|---|---|---|
| Ethylenglycol | 42 | ml |
| Optiblanc AC | 2.5 | g |
| Benzyl-alcohol | 18.3 | ml |
| Ascorbic acid | 0.05 | g |
| CD3 | 7 | g |
| Hydroxylamine chlorohydrate | 2.75 | g |

wherein the components were progressively and completely dissolved in the ethyleneglycol in the indicated order till a final solution of 67.5 ml was obtained.

Composition B

| | | |
|---|---|---|
| Water | 24 | ml |
| KOH 35% | 8.8 | ml |
| Diethylentriaminopentacetic acid | 1.6 | g |
| Diaminopropanoltetracetic acid | 1.5 | g |
| Potassium metabisulfite | 2 | g |
| Potassium carbonate | 32 | g |

EXAMPLE 12

The developer components for color photographic paper were confectioned in two concentrated liquid compositions the first being like composition A of example 11 but having only 0.028 g of Ascorbic acid and the second being the same as composition B of example 11, the quantity of both composition being such that one liter of developer replenisher ready for use can be prepared.

EXAMPLES 13, 14, 15, 16, 17 AND 18

The developer components for color photographic paper were confectioned in two concentrated liquid compositions, the first one being like composition A of Example 11 but having the following compounds instead of Ascorbic acid.

| Example | | Quantity | Final Volume |
|---|---|---|---|
| 13 | 1-hydroxyacetone | 0.3 ml | 67.5 ml |
| 14 | Hydroquinone | 0.025 g | 67.5 ml |
| 15 | 1-phenyl-3-pyrazolidone | 0.025 g | 67.5 ml |
| 16 | 1-phenyl-3-pyrazolidone | 0.010 g | 67.5 ml |
| 17 | 4,4-dimethyl-1-phenyl-3-pyrazolidone | 0.025 g | 67.5 ml |
| 18 | Methol | 0.025 g | 67.5 ml |

and the second composition being in all examples the same as composition B of example 11, the quantity of both compositions in each example being such that one liter of developer replenisher ready for use can be prepared.

EXAMPLE 19

The developer components for color photographic paper were confectioned in three concentrated liquid compositions necessary to prepare one liter of developer replenisher ready for use:

Composition A

| | | |
|---|---|---|
| Ethylenglycol | 20.5 | ml |
| Hydroxylamine chlorohydrate | 2.75 | g |
| Optiblanc AC | 2.5 | g |

Composition B

| | | |
|---|---|---|
| Ethylenglycol | 28 | ml |
| Benzyl alcohol | 18.3 | ml |
| Sodium metabisulfite | 0.9 | g |
| CD3 | 7 | g |

having a final volume of 50 ml.

Composition C

The same as composition B of example 10.

EXAMPLE 20

The developer components for color photographic paper were confectioned in three concentrated liquid compositions necessary to obtain one liter of developer replenisher ready for use.

Composition A

| | | |
|---|---|---|
| Ethylenglycol | 10 | ml |
| Hydroxylamine chlorohydrate | 2.75 | g |

having a final volume of 11.8 ml.

Composition B

| | | |
|---|---|---|
| Ethylenglycol | 42 | ml |
| Optiblanc AC | 2.5 | g |
| Benzyl alcohol | 18.3 | ml |
| Sodium Metabisulfite | 0.9 | g |
| CD3 | 7 | g |

having a final volume of 67 ml.

Composition C

The same as composition B of Example 10.

EXAMPLE 21

The developer components for color photographic negative were confectioned in two concentrated liquid compositions necessary to prepare one liter of developer replenisher ready for use:

Composition A

| | | |
|---|---|---|
| Ethylenglycol | 70 | ml |
| Hydroxylamine chlorohydrate | 1.5 | g |
| Sodium metabisulphite | 5 | g |
| CD4 | 5.3 | g |

wherein the components were progressively and completely dissolved in ethylenglycol in the indicated order so as to obtain a final solution of 76 ml.

Composition B

| | | |
|---|---|---|
| Water | 56 | ml |
| Diethylentriaminopentacetic acid | 2.57 | g |
| Potassium carbonate | 35 | g |
| Sodium sulfite | 4.7 | g |
| Potassium bromide | 1.1 | g |
| Potassium chloride | 0.3 | g |
| Potassium bicarbonate | 3.8 | g |

EXAMPLES 22, 23, 24, 25 AND 26

The developer components for color photographic negative were confectioned in two concentrated liquid compositions, as in Example 21, the first one being like composition A of Example 21 but having the following products instead of 50 ml of ethylenglycol and 1 g of sodium metabisulfite:

| Example | Solvent and Quantity | | $Na_2S_2O_5$ | Final Volume |
|---|---|---|---|---|
| 22 | Glycerin | 40 ml | 0.9 g | 45 ml |
| 23 | Diethylenglycol | 80 ml | 0.9 g | 85 ml |
| 24 | Propylenglycol | 80 ml | 0.9 g | 85 ml |
| 25 | Triethylen-glycol | 110 ml | 0.9 g | 115 ml |
| 26 | Ethylenglycol/glycerin | 20/15 ml | 1.5 g | 39 ml |

and the second composition being the same as composition B of example 21, the quantity of both compositions for each example being such that one liter of developer replenisher ready for use can be prepared.

EXAMPLE 27

The developer components for color photographic negative were confectioned in two concentrated liquid compositions in a quantity such as to prepare one liter of developer replenisher ready for use:

Composition A

| | | |
|---|---|---|
| Ethylenglycol | 50 | ml |
| Ascorbic acid | 0.1 | g |
| CD 4 | 5.3 | g |
| Hydroxylamine chlorohydrate | 3 | g |

wherein the components were progressively and completely dissolved in the ethylenglycole in the indicated order so as to obtain a final volume of 56 ml.

Composition B

The same as composition B of Example 21.

EXAMPLE 28

One liter of developer replenisher ready for use for color photographic paper was prepared in the following way: predetermined volumes of concentrated liquid compositions, containing the developer components, were added in sequence, under constant and equal stirring, into 800 ml of water as necessary to obtain one liter of developer replenisher ready for use and the time required to obtain a limpid solution was respectively measured for each adding; the test was repeated with water at three different temperatures, i.e. 20° C., 30° C. and 40° C. and using the volumes of the concentrated liquid compositions of examples 1 to 18 in comparison with volumes of developer concentrated liquid compositions for color photographic paper as available on the market, such volumes being such that one liter of the developer replenisher ready for use was obtained in all cases. The mixing times of the concentrated compositions of the present invention resulted generally to be better than those of similar prior art compositions. Hereinbelow we report in particular the data pertinent to an example of the present invention in comparison with prior art compositions present on the photographic market.

| Present invention developer composition | Quantity ml | | | | | Solubility time in $H_2O$ | | |
|---|---|---|---|---|---|---|---|---|
| $H_2O$ | 800 | 800 | 800 | 800 | 800 | / | / | / |

-continued

| Present invention developer composition | Quantity ml | | | | | Solubility time in $H_2O$ | | |
|---|---|---|---|---|---|---|---|---|
| Composition A - Example 11 | 67 | / | / | / | / | 30" | 22" | 22" |
| Composition B - Example 11 | 51.5 | / | / | / | / | 25" | 20" | 18" |
| Kodak $EP_2$ - Part A | | 52 | / | / | / | 1'45" | 1'30" | 1'15" |
| Kodak $EP_2$ - Part B | | 20.2 | / | / | / | 10" | 6" | 6" |
| Kodak $EP_2$ - Part C | | 20 | / | / | / | 10" | 7" | 6" |
| Kodak $EP_2$ - Part D | | 51.5 | / | / | / | 30" | 25" | 20" |
| Hunt Color Print 30 - Part A | | | 17 | / | / | 10" | —" | 7" |
| Hunt Color Print 30 - Part B | | | 32.9 | / | / | 4'30" | 3'15" | 3' |
| Hunt Color Print 30 - Part C | | | 48.2 | / | / | 28" | 20" | 20" |
| Russel Col. Posit. II - Part A | | | | 55 | / | 5' | 3'30" | 2'55" |
| Russel Col. Posit. II - Part B | | | | 16.5 | / | 10" | 8" | 6" |
| Russel Col. Posit. II - Part C | | | | 39 | / | 10" | 8" | 6" |
| Russel Col. Posit. II - Part D | | | | 53.4 | / | 25" | 22" | 20" |
| Arfo K-90R - Part A | | | | / | 78.5 | 4' | 3' | 2'30" |
| Arfo K-90R - Part B | | | | / | 20 | 20" | 15" | 15" |
| Arfo K-90R - Part C | | | | / | 78 | 30" | 30" | 30" |
| Arfo K-90R - Part D | | | | / | 12.2 | 50" | 35" | 35" |

The concentrated liquid compositions of Examples 1 to 27 were used to prepare the developer replenisher. Such developer replenisher was used to replenish the working solution, contained in the processor tank, with which the color photographic paper was developed. Such working solution was obtained by adding into water (to obtain one liter) 80% of the same concentrated compositions used to obtain the developer replenisher and the necessary quantity of inorganic antifoggant which, in the case of color paper developers, was 0.6 g of KBr and, in the case of color negative developers, was 0.48 g of KBr and 0.02 g of KJ.

EXAMPLE 29

Photographic developer working solutions ready for use for color photographic papers were obtained by pouring the concentrated liquid compositions of examples from 1 to 18 and in sequence the alkaline concentrated liquid compositions B of the respective examples and 0.6 g of KBr into a predetermined volume of water so as to make a final volume of one liter. Samples of 3M Color Print photographic papers were exposed and processed in the following sequence:

| | | | |
|---|---|---|---|
| Development | 3'30" | at | 32.8° C. |
| Bleach-Fixing | 1'3" | at | 32.8° C. |
| Washing | 3'30" | at | 32.8° C. |
| Drying | | at | 100° C. |

The photographic results of some developer working solutions prepared from concentrated compositions of the present invention (54.0 ml of part A and 40.4 ml of part B, A being both fresh and stored) are reported in the following Table.

| Concentrated Compositions | Sensitivity Colour | Fog | Speed | Medium Contrast | $D_{max}$ |
|---|---|---|---|---|---|
| 10 A | red | 0.12 | 2.45 | 2.50 | 2.50 |
| 10 B | green | 0.09 | 2.38 | 2.57 | 2.41 |
| | blue | 0.10 | 2.34 | 2.62 | 2.35 |
| 10 A(°) | red | 0.10 | 2.42 | 2.49 | 2.62 |
| 10 B | green | 0.10 | 2.40 | 2.84 | 2.51 |
| | blue | 0.10 | 2.28 | 2.57 | 2.38 |
| 11 A | red | 0.12 | 2.46 | 2.46 | 2.61 |
| 11 B | green | 0.09 | 2.38 | 2.59 | 2.50 |
| | blue | 0.11 | 2.31 | 2.66 | 2.50 |
| 11 A(°) | red | 0.11 | 2.36 | 2.15 | 2.60 |
| 11 B | green | 0.11 | 2.36 | 2.40 | 2.53 |
| | blue | 0.11 | 2.28 | 2.54 | 2.39 |
| 12 A | red | 0.13 | 2.46 | 2.30 | 2.61 |

-continued

| Concentrated Compositions | Sensitivity Colour | Fog | Speed | Medium Contrast | $D_{max}$ |
|---|---|---|---|---|---|
| 12 B | green | 0.11 | 2.40 | 2.40 | 2.52 |
| | blue | 0.11 | 2.33 | 2.52 | 2.36 |
| 12 A(°°) | red | 0.13 | 2.38 | 2.36 | 2.62 |
| 12 B | green | 0.11 | 2.35 | 2.61 | 2.55 |
| | blue | 0.12 | 2.28 | 2.81 | 2.45 |
| 13 A | red | 0.13 | 2.44 | 2.20 | 2.60 |
| 13 B | green | 0.11 | 2.35 | 2.37 | 2.54 |
| | blue | 0.11 | 2.29 | 2.58 | 2.36 |
| 13 A(°°) | red | 0.13 | 2.43 | 2.30 | 2.64 |
| 13 B | green | 0.11 | 2.39 | 2.52 | 2.53 |
| | blue | 0.12 | 2.29 | 2.50 | 2.37 |
| 16 A | red | 0.13 | 2.46 | 2.37 | 2.56 |
| 16 B | green | 0.10 | 2.39 | 2.38 | 2.46 |
| | blue | 0.11 | 2.33 | 2.50 | 2.34 |
| 16 A(°°) | red | 0.13 | 2.36 | 2.19 | 2.64 |
| 16B | green | 0.11 | 2.33 | 2.38 | 2.54 |
| | blue | 0.12 | 2.28 | 2.62 | 2.41 |

(°) Stored 24 h at 80° C.
(°°) Stored 20 days at 40° C.

EXAMPLE 30

Photographic developer working solutions ready for use for color photographic papers were prepared by pouring the concentrated liquid compositions of examples 19 and 20 but in a 20% lower volume quantity, in sequence the respective concentrated liquid compositions B and C also in a 20% lower volume quantity and 0.6 g of KBr into a predetermined volume of water so as to make a final volume of one liter. Samples of 3M Color Print photographic papers were exposed and processed following the same sequence of example 29.

The results of a developer working solution are reported hereinbelow also in comparison with developer working solutions prepared from the same concentrated liquid compositions but kept for a certain time at a high temperature.

| Concentrated Compositions | Sensitivity Colour | Fog | Speed | Medium Contrast | $D_{max}$ |
|---|---|---|---|---|---|
| 19 A | red | 0.12 | 2.40 | 2.12 | 2.57 |
| 19 B | green | 0.11 | 2.32 | 2.28 | 2.50 |
| 190 C | blue | 0.11 | 2.27 | 2.60 | 2.33 |
| 19 A(°) | red | 0.12 | 2.39 | 2.18 | 2.62 |
| 19 B(°) | green | 0.11 | 2.35 | 2.36 | 2.55 |
| 19 C | blue | 0.12 | 2.29 | 2.54 | 2.34 |
| 19 A(°°) | red | 0.14 | 2.41 | 2.16 | 2.58 |
| 19 B(°°) | green | 0.12 | 2.34 | 2.25 | 2.50 |

-continued

| Concentrated Compositions | Sensitivity Colour | Fog | Speed | Medium Contrast | $D_{max}$ |
|---|---|---|---|---|---|
| 19 C | blue | 0.11 | 2.29 | 2.54 | 2.41 |

(*) Stored 60 h at 80° C.
(**) Stored 30 days at 40° C.

EXAMPLE 31

Photographic developer working solutions ready for use for photographic color negatives were prepared by pouring the concentrated liquid compositions A of examples from 21 to 27 but a 20% lower volume quantity, in sequence the respective concentrated liquid compositions B also in a 20% lower volume quantity and 0.4 g of KBr plus 0.02 g of KJ into a predetermined volume of water so as to make a final volume of one liter. Samples of 3M Color Negative photographic color negatives were exposed and processed in the following sequence:

| | | | |
|---|---|---|---|
| Development | 3'15" | at | 38° C. |
| Bleaching | 6'30" | at | 38° C. |
| Washing | 3'15" | at | 38° C. |
| Fixing | 6'30" | at | 38° C. |
| Washing | 3'15" | at | 38° C. |
| Stabilization | 1'30" | at | 38° C. |

The results for a developer working solution are reported hereinbelow also in comparison with developer working solutions prepared from the same concentrated liquid compositions but kept for a certain time at a high temperature.

| Concentrated Compositions | Sensitivity Colour | Fog | Speed | Medium Contrast | $D_{max}$ |
|---|---|---|---|---|---|
| 27 A | red | 0.21 | 19.0 | 0.50 | 1.80 |
| 27 B | green | 0.43 | 21.0 | 0.60 | 2.25 |
| | blue | 0.72 | 21.5 | 0.59 | 2.59 |
| 27 A(*) | red | 0.26 | 18.2 | 0.51 | 1.65 |
| 27 B | green | 0.53 | 19.5 | 0.59 | 2.17 |
| | blue | 0.81 | 21.2 | 0.58 | 2.53 |

(*) Stored 30 days at 40° C.

The quantity of the solid components present in the concentrated developer compositions according to the present invention is as higher as possible depending upon their nature and the nature and quantity of the organic solvents used to solve them. Preferably it ranges from 5 to 50 grams for 100 ml of solution and more preferably from 15 to 30 grams. The ratios of the various components within the concentrated compositions themselves are those normal in the art when non otherwise stated in the specification. For example, this is true for sulphite compounds which (calculated in sulphite ions) can be added in quantities ranging from 0.05 to 2.0 moles per mole of p-phenylendiamine developing agent, preferably from 0.10 to 0.5.

I claim:

1. A concentrated color photographic developer solution to be mixed with an alkaline aqueous composition characterized by the fact that said concentrated solution is a liquid composition having no more than 5% volume of the total volume of said concentrated composition as water and includes 5 to 50 g per 100 ml of said solution of a p-phenylene-diamine compound dissolved in a photographically neutral organic solvent which is miscible with water.

2. A developer solution according to claim 1 characterized by the fact that said concentrated solution is a liquid composition having no more than 5% by volume of water and includes both the p-phenylenediamine compound and an antioxidant dissolved in said water miscible organic solvent.

3. A liquid concentrated composition of claim 2 including benzylalcohol.

4. A developer solution as in claim 1 characterized by the fact that said concentrated solution includes as an antioxidant, a sulfite compound.

5. A developer solution as in claim 1 characterized by the fact that said concentrated solution includes a hydroxylamine compound as an antioxidant.

6. A developer solution as in claim 1 characterized by the fact that said concentrated solution includes as ascorbic acid compound as an antioxidant.

7. A liquid concentrated composition of claim 6 including benzylalcohol.

8. A developer as in claim 6 characterized by the fact that said organic solvent is chosen from the group consisting of dihydric alcohols, polyhydric alcohols and polyoxyethyleneglycols, and mixtures thereof.

9. Developer for use in colour photography of claim 8 wherein said organic solvent is ethyleneglycol.

10. A developer as in claim 1 wherein said p-phenylene-diamine compound is 4-amino-N-ethyl-N-[β-methanesulfonamidoethyl)-m-toluidine.

11. A developer as in claim 1 wherein said p-phenylene-diamine compound is associated with benzylalcohol in the said liquid concentrated solution.

12. A liquid concentrated composition of claim 1 including benzylalcohol.

13. A developer solution as in claim 1 characterized by the fact that said concentrated solution includes both an ascorbic acid and a sulfite compound.

14. Developer for use in color photography of claim 1 characterized by the fact that said organic solvent is chosen from the group consisting of dihydric alcohols, polyhydric alcohols and polyoxyethyleneglycols, and mixtures thereof.

15. The developer solution of claim 1 wherein said concentrated solution is liquid at room temperature.

16. A method for preparing a color developer from concentrated prepared compositions which comprises mixing the concentrated developer of claim 1 with an aqueous alkaline solution.

17. The method of claim 16 wherein said concentrated developer contains both 1-phenylenediamine color developer and an antioxidant dissolved in said water miscible organic solvent.

18. The method of claim 17 wherein said antioxidant is selected from the group consisting of a sulfite compound, a hydroxylamine compound, and an ascorbic acid.

19. The method of claim 17 wherein said antioxidant is ascorbic acid and said organic solvent is selected from the group consisting of dihydric alcohols, polyhydric alcohols, polyethyleneglycols, and mixtures thereof.

20. The method of claim 17 wherein said aqueous alkaline solution also contains an antioxidant.

21. The method of claim 20 wherein said concentrated composition contains an ascorbic acid or a sulfite compound as an antioxidant and said aqueous alkaline solution contains a sulfite compound.

* * * * *

UNITED STATES PATENT AND TRADEMARK OFFICE

CERTIFICATE OF CORRECTION

PATENT NO. : 4,232,113

DATED : November 4, 1980

INVENTOR(S) : CARLO MARCHESANO

It is certified that error appears in the above—identified patent and that said Letters Patent is hereby corrected as shown below:

Column 1, line 54, delete "air" and insert --art--.

Column 4, line 46, insert the word "been" between --has-- and --evidenced--.

Column 5, line 41, delete "prepare" and insert --prepared--.

Column 12, line 64, delete "190 C" and insert --19 C--.

Signed and Sealed this

*Sixth* Day of *October 1981*

[SEAL]

*Attest:*

GERALD J. MOSSINGHOFF

*Attesting Officer*

*Commissioner of Patents and Trademarks*